United States Patent [19]

Hockaday

[11] Patent Number: 4,606,375

[45] Date of Patent: Aug. 19, 1986

[54] FLUIDIC DEVICE

[75] Inventor: Bruce D. Hockaday, Vernon, Conn.

[73] Assignee: United Technologies Corporation, Hartford, Conn.

[21] Appl. No.: 741,085

[22] Filed: Jun. 4, 1985

[51] Int. Cl.[4] ..... F15C 1/04; F15C 1/08

[52] U.S. Cl. ..... 137/828; 137/833; 137/840; 250/351; 250/352

[58] Field of Search ..... 137/828, 833, 840; 250/351, 352, 353

[56] References Cited

U.S. PATENT DOCUMENTS

| | | | |
|---|---|---|---|
| 2,824,235 | 2/1958 | Hahn, Jr. et al. | 250/351 |
| 3,228,411 | 1/1966 | Straub | 137/827 |
| 3,568,693 | 3/1971 | Vandrey | 137/1 |
| 3,721,257 | 3/1973 | DeSantis et al. | 137/828 |
| 4,184,768 | 1/1980 | Murphy et al. | 250/351 |
| 4,512,371 | 4/1985 | Drzewiecki et al. | 137/828 |

OTHER PUBLICATIONS

"Pneumatic to Electric Transducers", IBM Technical Disclosure Bulletin, Dec. 1962.

*Primary Examiner*—A. Michael Chambers
*Attorney, Agent, or Firm*—John Swiatocha

[57] ABSTRACT

An unfocused optical input signal is applied to an optically absorbent wall portion of an interaction region 30 in a fluidic device to effect flow impedance modulation thereat. The flow impedance modulation adjusts the velocity profile of the flow to achieve a desired output from the device.

5 Claims, 2 Drawing Figures

FIG. 1
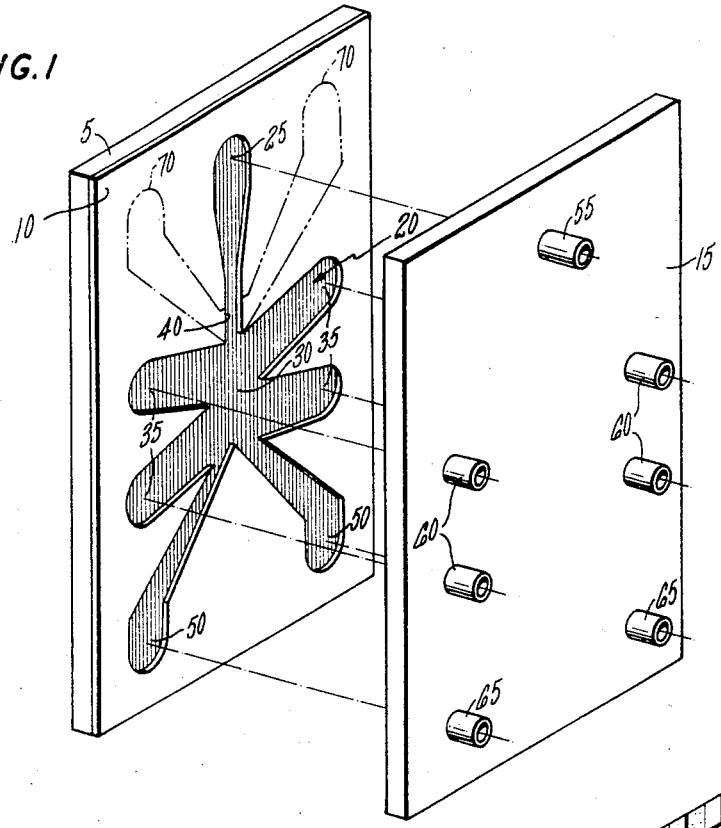
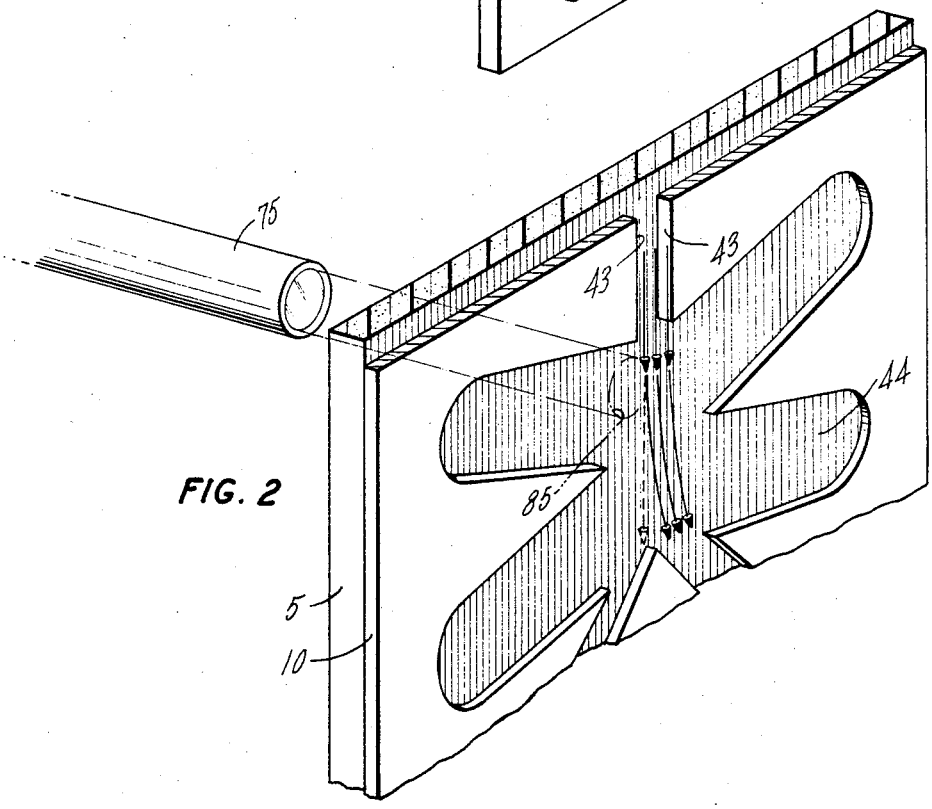
FIG. 2

FLUIDIC DEVICE

TECHNICAL FIELD

This invention relates generally to fluidic devices and more particularly to a device which converts an optical input signal to a fluidic output signal.

BACKGROUND ART

Electrical and pneumatic systems for industrial and aeronautical control are well known in the art. Recently, however, optical systems have received increasing attention as possible alternatives to such electrical and pneumatic control systems. In industrial applications, optical controls tend to be inherently safer, immune to electromagnetic noise and lower in cost than corresponding electrical systems. Also, optical fibers weigh less, are more compact and provide a larger signal bandwidth than pneumatic or electrical control lines. The benefits offered by optical control systems are particularly noteworthy in aeronautical applications. In military aircraft, for example, optical controls are more survivable in the presence of electromagnetic interference, electromagnetic pulses, electrostatic interference and high-energy particles than functionally similar electrical systems.

While optical control system components such as optical power sources, glass fiber signal transmission lines and optical connectors are currently available for control system applications, hardware for converting optical input signals to fluid mechanical output signals, as would be necessary for the optical control of such apparatus as hydraulic motors and the like, have yet to be developed.

DISCLOSURE OF INVENTION

It is therefore, a principal object of the present invention to provide an improved opto-fluidic interface for converting optical input signals to fluidic pressure output signals.

It is another object of the present invention to provide such an opto-fluidic device characterized by structural economy and operational simplicity.

It is another object of the present invention to provide such an opto-fluidic device with enhanced reliability.

It is another object of the present invention to provide such an opto-fluidic device which is readily adaptable for use with known fluidic control components.

These and other objects, which will become more readily apparent from the following detailed description, taken in connection with the appended claims and accompanying drawing, are attained by the fluidic control device of the present invention in which the fluidic output of the device is controlled by the application thereto of an optical input signal to modulate the drag on a passage wall of the device by flow therethrough. In the preferred embodiment, the optical input signal is applied to an optically absorbent portion of the passage wall. This application of optical energy heats that portion of the wall, thereby lowering the viscosity of the fluid flowing through the device in proximity to the heated wall portion. The change in viscosity changes the velocity profile of the flow thereby turning at least part of the flow to achieve a desired fluidic output signal. The optical input signal may comprise a laser beam and the optically absorbent material, a graphite-epoxy composite. The flow passages of the fluidic device may take the shape of a laminar proportional amplifier, which may be serially connected to additional amplifier stages in a cascade arrangement to achieve a desired output signal amplitude.

BRIEF DESCRIPTION OF THE DRAWING

FIG. 1 is an exploded, perspective view of a fluid handling portion of the fluidic device of the present invention;

FIG. 2 is an enlarged, isometric, fragmentary view of part of that portion of the device shown in FIG. 1 as well as an optical portion of the device.

BEST MODE OF CARRYING OUT THE INVENTION AND INDUSTRIAL APPLICABILITY THEREOF

Referring to the drawing and particularly FIG. 1 thereof, the fluidic device of the present invention comprises a laminar arrangement of plates 5, 10 and 15, plate 5 being formed from, or coated, on, the interior surface thereof, with an optically absorbent material such as a graphite-epoxy composite 20 having the graphite reinforcement fibers thereof disposed generally in parallel orientation to fluid flow through the device (downwardly in FIG. 1). Plate 10 has a network of flow passages provided therein either by machining, etching or equivalent techniques. As illustrated, supply passage 25 feeds into an open area (interaction region) 30 between four generally symmetrically arranged vent passages 35 through a supply nozzle 40. As best seen in FIG. 2, the etched portions of plate 10 form two sidewalls 43 orthogonally disposed with respect to a bottom wall 44 formed by the optically absorbent composite.

Output passages 50, which are also etched in plate 10, communicate with region 30. Plate 15 is drilled and provided with a plurality of taps (ports) for making fluid connections to the various passages in plate 10. Thus, port 55 connects supply passage 25 with a suitable source of pressurized fluid (not shown) while ports 60 communicate with vent passages 35. Ports 65 communicate with output passages 50.

Those skilled in the art will recognize that the fluid handling portion of the fluidic device described hereinabove resembles a laminar proportional fluidic amplifier without the normal control ports (shown as they would otherwise appear by phantom lines 70). Thus, it will be seen that fluid introduced to inlet passage 25 through port 55 flows through nozzle 40, through open region 30 between vent passages 35 and is split between output passages 50. Pressure build up within interaction region 30 is prevented (constant pressure maintained) by venting at passages 35 through ports 60. Those skilled in the art will also note that by controlling the flow conditions through nozzle 40, the device may function as an amplifier (by turning some of the flow through the device toward one or the other of the output passages 50 to achieve a desired difference in pressure therebetween) or a switch (wherein the entire flow is diverted from one output passage 50 to the other). While in the prior art, such input signals were fluidically applied through control ports 70, in the present invention, the input signal comprises an optical signal applied directly to bottom wall 44 of the device.

Referring to FIG. 2, the optical input signal to the fluidic device comprises an unfocused optical signal applied asymmetrically to the optically absorbent composite. The means for applying this signal comprises a source of light such as a laser, a light emitting diode, or any fiber optically-conducted light source 75. Optical energy from the laser is directed to a location 85 on the optically absorbent composite, location 85 being displaced from the center of region 30. This optical energy heats location 85 thereby heating that portion of the flow through the device proximal to location 85. The orientation of the graphite fibers parallel to the direction of flow minimizes the conduction of heat across region 30 (perpendicular to the direction of flow). Such heating of the flow lowers the viscosity thereof, thereby decreasing flow drag on the location 85. Lowering the wall drag adjusts the velocity profile of the flow thereby turning at least a portion of the flow toward one of the outlet passages. This effects an imbalance in the flow conditions between the outlet passages, thus defining a fluidic pressure output signal therebetween.

It will thus be apparent that the fluidic device of the present invention provides an uncomplicated yet effective and reliable control device for converting an optical input signal to a fluidic output signal. By the application of unfocused optical energy directly to a location on an optically absorbent portion of the device, flow conditions within the device and therefore imbalances between the output ports can be controlled by means of modulating flow impedance. With appropriate sizing of the passages and intensification of the optical input signal, a predetermined output (a predetermined pressure difference between the output ports) is reliably attained with accuracy and repeatability.

Those skilled in the art will readily appreciate the innumerable applications for the present invention. For example, in "fly by light" aircraft control systems, optical input signals can be applied to fluidic devices such as that of the present invention and the output pressure difference of the device applied to such apparatus as hydraulic actuators to set the position of aircraft control surfaces and the like. It will also be noted that the fluidic device of the present invention is readily adaptable for use with known fluidic devices such as known laminar proportional amplifiers for further amplification of the output signal across output ports 65. In such an arrangement, the output signal across ports 65 would be fed as an input signal to a state-of-the-art laminar proportional amplifier of a shape similar to that shown in FIG. 1 including control ports 70. With such an arrangement, fluidic input signals (output signals from ports 65) applied to a pressurized supply flow would result in amplification of the input signals at the output of the laminar proportional amplifier. Further amplification (and if necessary, further control by way of fluidic control signals input to the amplifier control port) would therefore be readily achieved by further cascading of the output signals with further stages of fluidic amplification. Also, the invention herein is readily adaptable to simple fluidic resistors whereby drag over the walls of the resistor by flow therethrough is controlled by heating the walls of the resistor with an optical input signal.

While a particular embodiment of the present invention has been shown and described, it will be appreciated that the disclosure herein will suggest various alternate embodiments to those skilled in the art. Thus, while in the description herein, the optical input signal is applied to a single location in region 30, it will be readily appreciated that an opposite output pressure signal may be achieved by directing the optical input signal to an opposite location within region 30. Furthermore, while the optically absorbent material has been described as a graphite-epoxy composite, various other compositions such as carbon impregnated ceramic may suggest themselves to those skilled in the art. Also, the optical input signal may be applied (as shown) to the back of plate 5 or, if plate 15 is transparent, to the front of plate 5. Similarly, various other arrangements of fluidic passages adaptable to fluidic control by flow impedance modulation resulting from the application of an optical input signal to an optically absorbent flow passage, may also suggest themselves to those skilled in the art. By way of example, fluidic pressure signals may be applied to control ports 70 to compensate for any asymmetries in the device. Therefore, it is intended by the following claims to cover any such alternate embodiments as fall within the true spirit and scope of this invention.

Having thus described the invention, what is claimed is:

1. In a fluidic device accommodating a continuous fluid flow therethrough, said fluidic device comprising a supply nozzle and at least one outlet port, a desired output of said fluidic device, defined by the flow conditions at said outlet port, being attained by the input of a control signal to said fluid flow for regulating the flow conditions thereof, the improvement characterized by:

said control signal comprising an optical signal;

said fluidic device including a passage disposed upstream of said outlet port and accommodating said fluid flow, said passage comprising a wall structure, at least a portion which is formed from an optically absorbent material; and means for controlling the drag on said flow due to contact thereof with said optically absorbent wall portion by the direct application of said optical signal to said optically absorbent wall portion, thereby regulating the velocity profile of said fluid flow within said device to attain said desired output therefrom.

2. The fluidic device of claim 1 characterized by a pair of juxtaposed outlet ports, said outlet ports being separated from said supply nozzle by an interaction flow region, one wall of which is formed from said optically absorbent material, a desired output of said fluidic device, defined by an imbalance in flow conditions between said outlet ports, being attained by a deflection of said fluid flow caused by said wall drag modulation.

3. The fluidic device of claim 1 characterized by said means for providing said unfocused optical signal to said optically absorbent wall portion, comprising a laser.

4. The fluidic device of claim 1 characterized by said optically absorbent material comprising a composite including graphite fibers disposed in an epoxy matrix.

5. The fluidic device of claim 4 characterized by said graphite fibers being disposed in generally parallel orientation to said fluid flow.

* * * * *